US006176632B1

(12) United States Patent
Kageyama et al.

(10) Patent No.: US 6,176,632 B1
(45) Date of Patent: Jan. 23, 2001

(54) LIQUID CONTAINER

(75) Inventors: Hidehei Kageyama; Yoshio Noguchi; Tomohiro Fueki, all of Kawagoe (JP)

(73) Assignee: Kotobuki Printing Co., Ltd., Kyoto-fu (JP)

( * ) Notice: Under 35 U.S.C. 154(b), the term of this patent shall be extended for 0 days.

(21) Appl. No.: 09/387,266

(22) Filed: Aug. 31, 1999

(30) Foreign Application Priority Data

Aug. 9, 1999 (JP) ..... 11-225812

(51) Int. Cl.[7] ..... A46B 11/02

(52) U.S. Cl. ..... 401/186; 401/153; 401/169; 401/202; 401/206; 401/279; 401/286

(58) Field of Search ..... 401/153, 169, 401/183–186, 202, 206, 205, 269, 278, 279, 286, 288

(56) References Cited

U.S. PATENT DOCUMENTS 2,547,287 * 4/1951 Sanders et al. ..... 401/279 X
4,859,104 * 8/1989 Roeder et al. ..... 401/202
5,259,682 * 11/1993 Uchiyama ..... 401/186 X
5,707,164 * 1/1998 Iwamoto et al. ..... 401/206

* cited by examiner

*Primary Examiner*—Henry J. Recla
*Assistant Examiner*—Kathleen J. Prunner
(74) *Attorney, Agent, or Firm*—McGinn & Gibb, PLLC

(57) ABSTRACT

A liquid container such that the liquid received in it will not easily spring out from its tip even if it is wrongly operated, comprises a tank portion for receiving a liquid, a knock bar stretching axially movably within the tank portion which is designed to have on its axial tip portion a pump shelf portion whose diameter have been enlarged, an induction bar fixed into the tip of the knock bar, a brush provided on the tip side of the induction bar, and a spring for always energizing the above knock bar and induction bar rearward. On the internal periphery surface of the above tank portion, a plurality of ribs are formed which stretch axially and on top of which the above pump shelf portion can slide, the internal periphery surface ahead of the ribs is at the same level as and continuous with the top face of the ribs and designed as a diameter-reducing portion where the pump shelf portion can slide. The pump shelf portion slidably touches the ribs when it is not biased.

9 Claims, 5 Drawing Sheets

LIQUID CONTAINER

BACKGROUND OF THE INVENTION

1. Field of the Invention

The present invention relates to a liquid container adaptable for storing a liquid such as cosmetic nail polish, correction fluid and so on and designed to have on its tip portion an application tip body for the application of the liquid.

2. Description of the Related Art

There is described a liquid container of this type in Japanese Patent Laid-Open No. 4-57771 which comprises: an elastic tank portion for receiving a liquid, a liquid-supplying member disposed axially slidably within the tank, and a pump space portion formed between the liquid-supplying member and the tank portion whose pumping function to discharge the above liquid is actuated by the advancement of the liquid-supplying member. The liquid-supplying member comprises a pump shelf portion whose outside diameter is the same as the inside diameter of a pump internal wall of the pump space portion formed within the tank portion. When the elastic tank portion is shrinked so that the liquid-supplying member will move forward, the pump shelf portion of the liquid-supplying member moves on the pump internal wall of the pump space portion, as a result, almost all the liquid in the pump space portion is supplied from the pump space to the outside by the pumping function.

However, such a conventional art liquid container has a problem such that, when the rear end portion of the tank portion is pressed by mistake, causing the tank portion to be shrinked, the liquid may spring out unexpectedly undesirably to the outside. If a cap is not provided on the tip of the liquid container, the surrounding will be soiled, and even if a cap is provided, the liquid having spread may be solidified within the cap, which may cause a problem that the cap becomes hard to take off.

The liquid container described in the above publication is designed in such a manner that clearance is made axially between the pump shelf portion and the pump internal wall when the tank portion is not shrinked, and as long as the pump shelf portion moves within the clearance, the liquid does not spring out ahead of the tip portion of the container. However, a small clearance is not very effective, and too large a clearance may cause a problem that, when the liquid-supplying member moves axially within the tank portion, undesirable radial movement becomes bigger, which leads to collision of the pump shelf portion with an edge of the pump internal wall.

Further, since the tank portion is formed integrally with the bellows-shaped elastic portion, it should have both rigidity which is required for storing liquid and flexibility which is required for easy handling thereof, consequently the tank portion becomes difficult to manufacture.

SUMMARY OF THE INVENTION

The present invention was made in light of the above difficulties. Accordingly, it is an object of the present invention to provide a liquid container such that, if it is handled by mistake, the liquid will not easily spring out therefrom.

It is another object of the present invention to provide a liquid container which is easy to manufacture.

In order to attain the above objects, there is provided, according to the present invention, a liquid container which comprises:

a tank portion for storing a liquid, a knock bar lying axially movably within the tank portion which is designed to have on its axial tip a pump shelf portion whose diameter have been enlarged, an induction bar fixed into a tip of the knock bar for opening/closing a tip opening of the tank portion, an application tip body provided on a tip side of the induction bar, energizing means for always energizing the above knock bar and induction bar rearward, a knock body operatable to bias the knock bar within the above tank forward, wherein a plurality of ribs are axially formed on the internal periphery surface of the tank portion, on top of which the pump shelf portion can slide, an internal periphery surface ahead of the ribs of the tank portion is at the same level as and continuous with the top face of the ribs and designed as a diameter-reducing portion where the pump shelf portion can slide, and the pump shelf portion of the knock bar slidably touches the top of the ribs when it is not biased.

In this container, even when the knock bar is biased forward as a result of a wrong operation of the knock body, since the pump shelf portion of the knock bar slides on top of the ribs of the tank portion in the early stage of knocking so that no pump room will be formed between the tank portion and the knock bar/induction bar, the liquid is prevented from being unexpectedly discharged from the application tip body. Since the knock bar slides on top of the ribs, it dose not move undesirably radially, but moves steadily axially.

The liquid container may further comprise a tail stopper fixed on a rear end portion of the tank portion, a rear ring fitted on a rear end of the tail stopper, and a bellows-shaped elastic body sandwiched between the tail stopper and the rear ring. The manufacturing of the liquid container becomes easier since the tank portion and the bellows-shaped elastic body are formed independently of each other.

The tail stopper, the rear ring and the elastic body may configure a previously integrally formed unit. The whole assembly of the liquid container becomes easier since a tail stopper, a rear ring and an elastic body are attached to the tank potion as a previously formed unit.

The liquid container may further comprise a cap which is adapted to be detachably attached on a tip portion of the tank portion and designed to protect the application tip body, the cap comprising: a cap body, a solvent-impregnation medium which is impregnated with a solvent for preventing the above application tip body from being dried up and housed in an inner side portion of an inside of the cap body, a partition member fixed within the cap body for dividing the above solvent-impregnation medium from an open side portion of the cap body, solvent flowing-out means provided radially almost centrally in the above partition member for letting the vapored solvent out of the solvent-impregnation medium flow out, an opening/closing member disposed within the open side portion of the cap body for opening/closing the above solvent flowing-out means, energizing means for always energizing the opening/closing means in such a direction as to close the solvent flowing-out means, and an inner cap fixed inside the above opening/closing member, Wherein a solvent passage for letting the vaporized solvent from the above solvent flowing-out means pass through is defined between the external surface of the above inner cap and the internal surface of the above opening/closing member, further a second solvent passage via which the above solvent passage and the above application tip body communicate with each other is formed between the external and internal surfaces of the inner cap, and when the cap is attached to the liquid container, the above opening/closing member is biased so that it opens the above solvent flowing-out means, while the above application tip body being inserted into the above inner cap, as a result of which the vapored solvent out of the solvent-impregnation medium is allowed to pass through the solvent flowing-out means, the above solvent passage and the second solvent passage, so as to reach the application tip body.

When the cap is not being used and attached to the liquid container in order to protect its application tip body, since the above opening/closing member is pushed in such a direction as to open the above solvent flowing-out means, the vaporized solvent out of the solvent-impregnation medium is allowed to pass through the solvent flowing-out means, the solvent passage formed between the opening/closing member and the inner cap, and the second solvent passage formed between the external and internal surfaces of the inner cap, so as to reach the application tip body, as a result of which the application tip body can be moistened and prevented from being dried up. In addition, in cases where the pump shelf portion of the above knock bar advances beyond the ribs as a result of the wrong knocking operation, since the application tip body is inserted into the inner cap, the viscous liquid having sprung out from the application tip body may scatter mostly within the inner cap, but will never reach the solvent flowing-out means nor the solvent passage, never clog them, and therefore, the supply of the vapored solvent is never obstructed. The second solvent passage can be prevented from being clogged with the viscous liquid having sprung out from the application tip body by increasing its cross-sectional area or by locating it to the tank portion side away from a base portion of the application tip body.

On the other hand, when the cap is detached from the liquid container, since the energizing means works to bias the opening/closing member in such a direction as to close the solvent flowing-out means, the solvent can be prevented from vaporing and flowing out of the solvent-impregnation medium.

The above second solvent passage may be an opening formed in the periphery surface of the inner cap. The second solvent passage can be prevented from being clogged with the viscous liquid by adapting the opening formed in the periphery surface of the inner cap for the above second solvent passage, consequently the vaporized solvent out of the solvent-impregnation medium can pass through the solvent flowing-out means, the solvent passage formed between the opening/closing member and the inner cap, and the opening of the inner cap, and finally reach the application tip body.

The above solvent flowing-out means may comprise a through-hole formed radially almost centrally in the partition member, a cylindrical portion sliding through the through-hole, and a flange portion which is formed independently of the cylindrical portion and integrally connected to a tip side of the cylindrical body, in the cylindrical portion a hole is formed via which the inner side portion of the cap body and the above solvent passage communicate with each other, a periphery of the through-hole in the partition member is a projecting edge projecting toward the innermost portion of the cap body, and the above projecting edge is tightly touchable to the above flange portion. Since the cylindrical portion and the flange portion are configured independently of each other, moldability of each of the parts can be improved and they can be easily manufactured. Since the flange portion is independent of the cylindrical portion having a hole formed on it, the flange portion can be molded in such a manner that it has no parting line formed on it, consequently it is avoidable that unexpected clearance is formed by the parting line, the clearance which is likely to cause the evaporation and flow-out of the solvent when the flange portion tightly touches the projecting portion of the partition member.

The present disclosure relates to subject matter contained in Japanese Patent Application No. Hei 11-225812, filed on Aug. 9, 1999, which is expressly incorporated herein by reference in its entirety

DETAILED DESCRIPTION OF THE PREFERRED EMBODIMENTS

Figure 1:
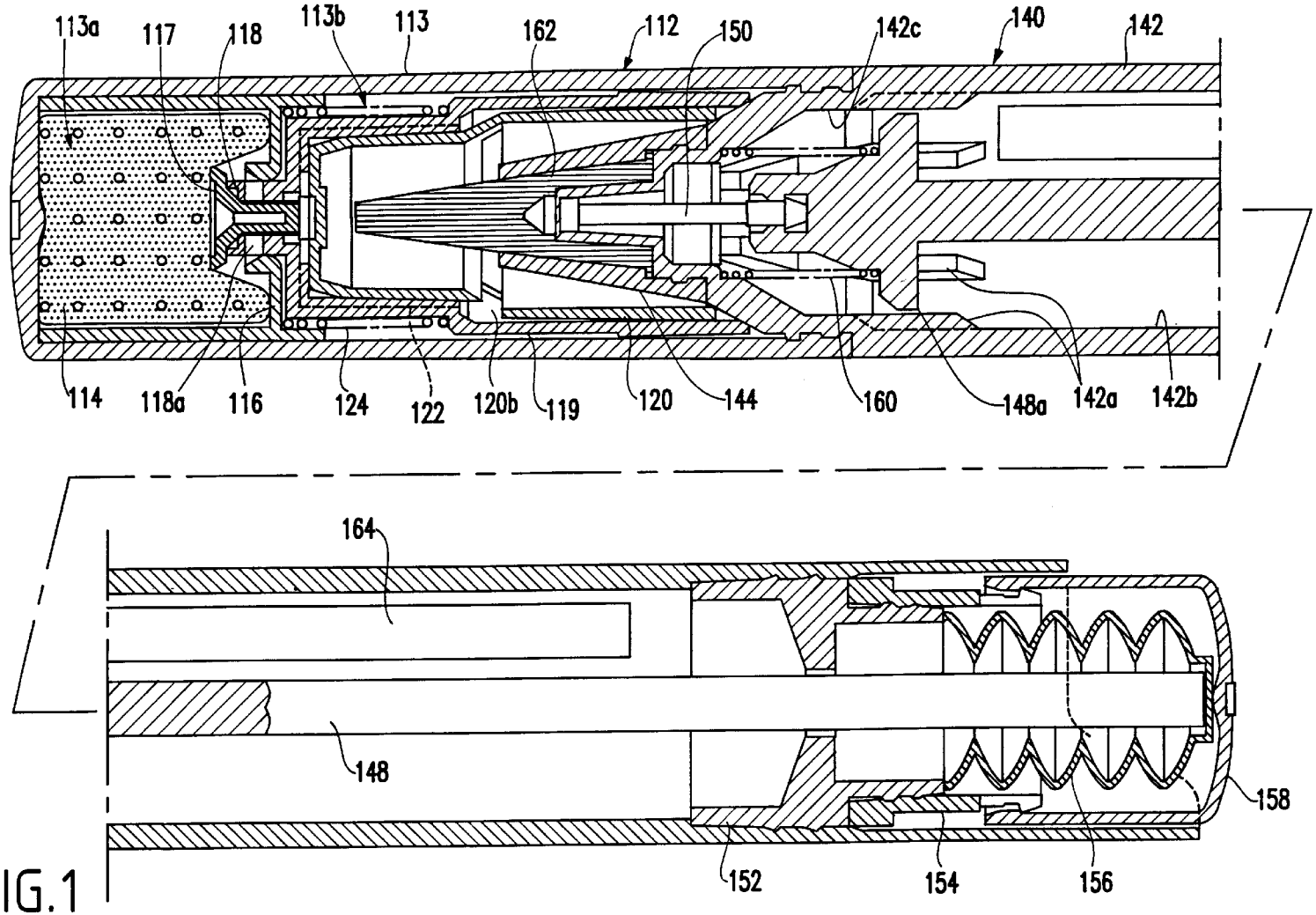
FIG. 1 is a vertical sectional view of a liquid container embodying the present invention.
Figure 2:
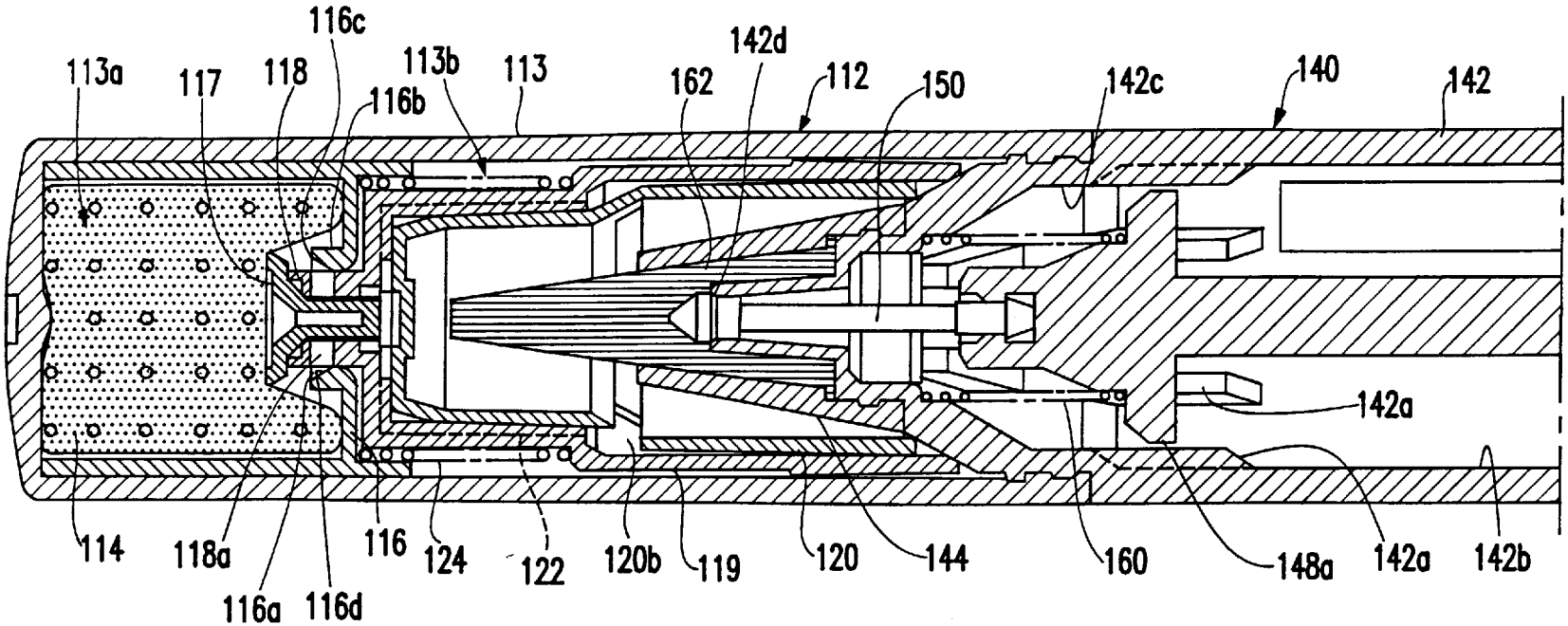
FIG. 2 is a partially enlarged view of FIG. 1 as a cap is attached to the liquid container.

Preferred embodiments of the present invention will be illustrated with reference to the accompanying drawings.

FIGS. 1 to 6 are views showing a first embodiment of the present invention.

Referring to the drawings, reference numeral 140 denotes a liquid container which comprises: a tank portion 142 which serves as an external cylinder for receiving a viscous liquid such as cosmetic nail polish, correction fluid and so on, a tip fitting 144 fixed on the tip portion of the tank portion 142, a knock bar 148 lying axially movably within the tank portion 142, an induction bar 150 whose tip side penetrates the tank portion 142 when its rear end is press-fitted onto the tip of the knock bar 148, a tail stopper 152 fixed to the rear end portion of the tank portion 142, a rear ring 154 fitted onto tail stopper 152, a bellows-shaped elastic body 156 sandwiched between the tail stopper 152 and the rear ring 154, a knock body 158 which can knock the tank portion 142 and covers the rear end of the elastic body 156, a spring 160 inserted between the shelf surface inside of the tank portion 142 and the knock bar 148 which serves as an energizing means for always energizing the knock bar 148 and the induction bar 150 rearward, a brush 162 as an application tip body projecting from the tip fitting 144 with its base end fixed within the tip fitting 144, and a stirring body 164 designed to freely move within the tank portion 142. On the tip of the induction bar 150, formed is an expanded shelf portion 150*a* which always touches the tip of the tank portion 142 to seal the tip opening 142*d* thereof.

Preferably, polyamide resins or polyacrylonitrile-based thermoplastic resins are used for the parts, such as the tank portion 142, the knock bar 148 and the tail stopper 152, which directly contact with the viscous liquid.

The tail stopper 152, the rear ring 154 and the elastic body 156 configure a unit which can be previously assembled in such a manner that the rear ring 154 is fitted onto the rear stopper 152 with the tip of the elastic body 156 sandwiched therebetween. The unit may also be configured in such a manner that the knock body 158 is engaged with the rear ring 154.

The whole assembly operation of the liquid container 140 is such that the knock bar 148, the induction bar 150 and the spring 160 are inserted in the tank portion 142, the brush 162 and the tip fitting 144 are fixed on the tip of the tank portion 142, followed by attaching a cap 112 described below. Then the tank portion 142 is filled with a viscous liquid from its rear side in the state where it is raised straight with the cap 112 kept downward, and the unit previously formed of the tail stopper 152, the rear ring 154 and the elastic body 156 is press-fitted into the tank portion 142 from its rear side.

Figure 6:
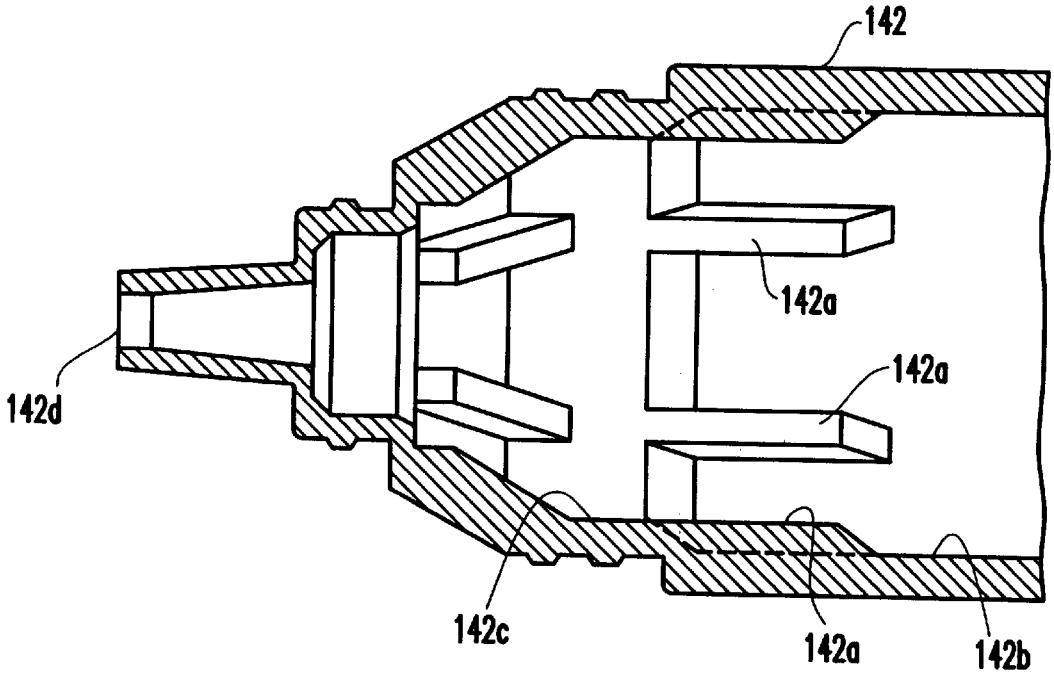
FIG. 6 is a cross-sectional view of the tip portion of the tank portion shown in FIG. 1.

As illustrated in FIG. 6, in the internal periphery surface of the tank portion 142, formed are a plurality of ribs 142*a* which stretch axially. The portion behind the ribs 142*a* has an diameter-enlarging portion 142*b* where the inside diameter of the external cylinder 142 is enlarged, and the portion ahead of the ribs 142*a* has a diameter-reducing portion 142*c* where the inside diameter of the external cylinder 142 is reduced, whose internal surface is at the same level as and continuous with the ribs 142*a,* and is smaller than the diameter-enlarging portion 142*b*. And on the tip of the above knock bar 148, formed is an diameter-enlarging portion 148*a* whose outside diameter is almost the same as that of the diameter-reducing portion 142*c*. Accordingly, the pump shelf portion 148*a* is slidable on top of the ribs 142*a* of the tank portion as well as on the diameter-reducing portion 142*c*. The pump shelf portion 148*a* of the knock bar 148 energized rearward by the energizing force of the spring 160 is always located at point where ribs 142*a* are formed and slidably touches the top surface of the ribs 142*a*.

The liquid container 140 is provided with a cap 112 which is adapted to be detachably attached to the tip portion of the tank portion 142 and designed for protecting the brush 162 not in use.

Cap 112 comprises a cap body 113 whose innermost portion 113*a* is provided with a solvent-impregnation medium 114 made up of, for example, felt and cotton which is impregnated with a solvent comprising the same liquid as the viscous liquid, the dilution thereof or the like.

Within the cap body 113, a partition member 116 is fixed which partitions the cap body 113 into the innermost portion 113*a* and an open side portion 113*b* and divides the solvent-impregnation medium 114 from the open side portion 113*b*. In the partition member 116 radially almost centrally formed is a through-hole 16*a* whose periphery is a projecting edge 116*b* projecting toward the innermost portion 113*a*. And inside the projecting edge 116*b,* there are formed an inclined face 116*c* inclined toward the central axis of the cap 112 and a flat face 116*d* which is located at the end of the inclined face 116*c* closest to the central axis of the cap 112 and lies in right angles to the axis.

Figure 3A:
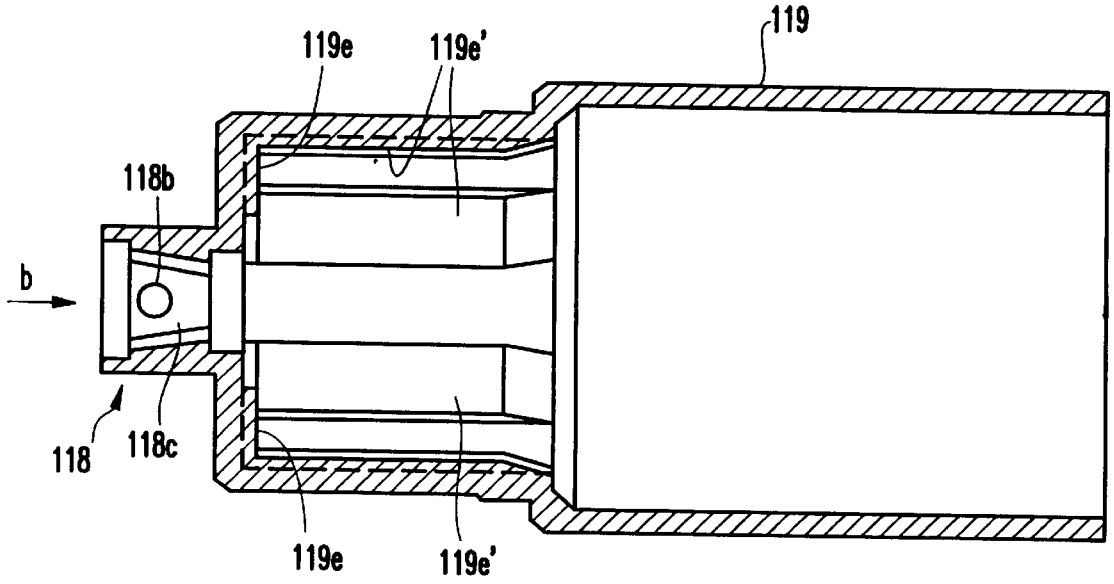
FIG. 3(*a*) is a cross-sectional view of the opening/closing member and the cylindrical portion shown in FIG. 1, and FIG. 3(*b*) is a view taken in the direction of the arrow b of FIG. 3(*a*)
Figure 3B:
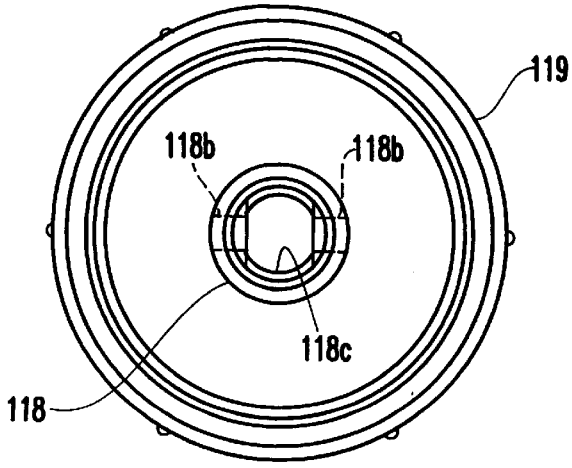
Figure 4A:
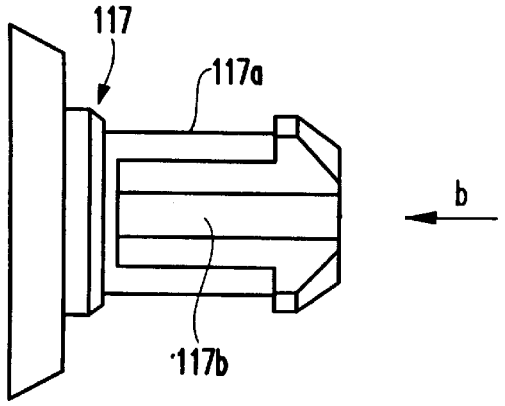
FIG. 4(*a*) is a side view of the flange portion shown in FIG. 1, FIG. 4(*b*) is a view taken in the direction of the arrow b of FIG. 4(*a*), and FIG. 4(*c*) is a view taken along a line c—c of FIG. 4(*b*)
Figure 4B:
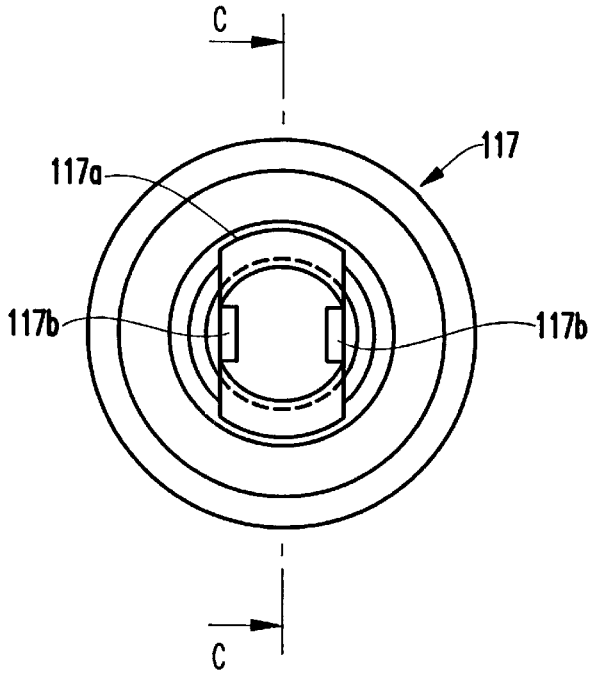
Figure 4C:
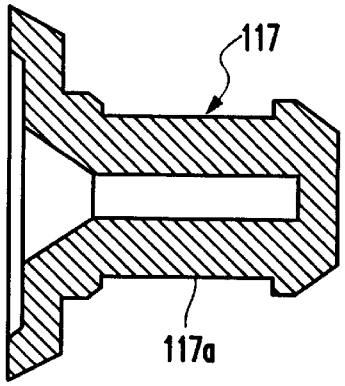

A cylindrical portion 118 is slidably inserted into the through-hole 116*a* and a flange portion 117 which is formed independently of the cylindrical portion 118 is press-fitted integrally into the tip side of the cylindrical portion 118. The through-hole 116*a,* the cylindrical portion 118 and the flange portion 117 configure a solvent-impregnation medium. In the cylindrical portion 118, a transverse hole 118*b* and a longitudinal hole 118*c* whose one end communicates with the above transverse hole 118*b*. The longitudinal hole 118*c* is in the form of ellipse which is circle some parts of which are cut, as shown in FIG. 3(*b*), and the flange portion 117 has a projecting portion 117*a* whose cross section is in the form of ellipse (refer to FIG. 4(*b*)) corresponding to the shape of the longitudinal hole 118*c* so that it can be press-fitted thereinto. And there is formed a communication groove 117*b* communicating with the transverse hole 118*b* longitudinally along the projecting portion 117*a*.

The flange portion 117 is designed to be tightly touchable at the above flat face 116*d* of the projecting edge 116*b* of the partition member 116 so that the cylindrical portion 118 integrally connected to the flange portion 117 cannot slip out of the partition member 116.

The cylindrical portion 118 is integrally formed together with a cylindrical opening/closing member 119 disposed on the open side portion 113*b* relative to the partition member 116. The other end of the above longitudinal hole 118*c* is in communication with the inside of the opening/closing member 119. A spring 124 as an energizing means is inserted between the opening/closing member 119 and the partition member 116 and always energizes the opening/closing member 119 away from the partition member 116, so that the cylindrical portion 118 is energized toward the open side portion 113*b* away from the partition member 116.

A plurality of ribs 119*e* and 119*e*' are formed on the internal surface of the opening/closing member 119 (refer to FIG. 3), and an inner cap 120 is fixed inside the opening/closing member 119 so that it can press-touch at the ribs 119*e* and 119*e*'.Clearance is defined between the internal surface of the opening/closing member 119 and the external surface of the inner cap 120 where ribs 119*e* and 119*e*' are not formed. The clearance serves as a solvent passage 122 communicating with the passage formed of the longitudinal hole 118*c* of the above cylindrical portion 118 and the communication groove 117*b* formed in the above flange portion 117.

Figure 5:
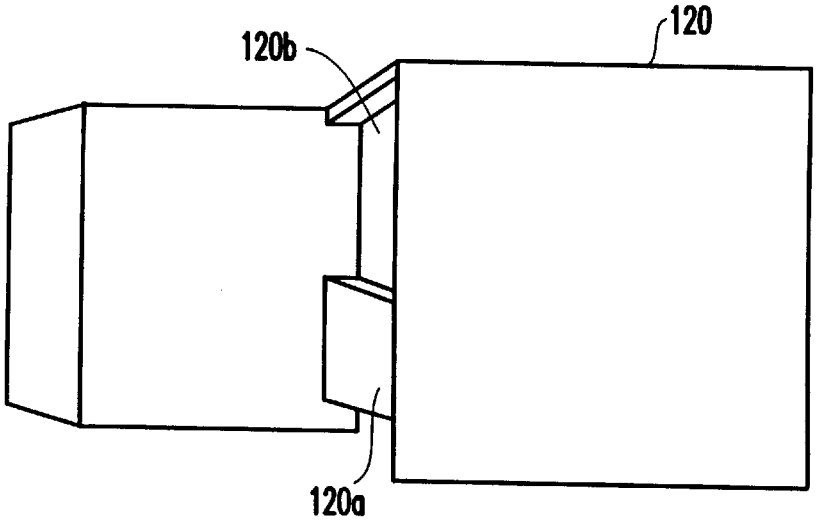
FIG. 5 is a side view of the inner cap.

As shown in FIG. 5, a taper portion 120*a* spreading radially outwardly is formed longitudinally centrally in the inner cap 120, and on the taper portion 120*a* a plurality of openings 120*b* are formed separatedly in the circumferential direction in such a manner that they configure a second solvent passage via which the external and internal surfaces of the inner cap 120 communicates with each other. The inside space of the inner cap 120 is designed as a space for the brush 162 being inserted.

The whole cap 112 having such a configuration as described above can be assembled by previously forming the parts except the cap body 113, that is, the solvent-impregnation medium 114, the partition member 116, the flange portion 117, the cylindrical portion 118, the opening/closing member 119 and the inner cap 120 into a unit and pressing the unit into the cap body 113.

The action of the liquid container 140 described so far will be describes below.

When the liquid container 140 is not in use, the induction bar 150 and the knock bar 148 are energized rearward by the spring 160, and the expanded shelf portion 150*a* seals up the tip opening 142*d* of the tank portion 142, accordingly the liquid will never flow out from the tank portion 142 to the outside.

When using this liquid container 140, first the cap 112 is detached, and the knock cap 158 is knocked so as to shrink the above elastic body 156, which causes the knock bar 148 and the induction bar 150 to move forward against the energizing force of the spring 160. This in turn causes the pump shelf portion 148*a* of the knock bar 148 to move forward while sliding on the ribs 142*a* of the tank portion 142 and then on the diameter-reducing portion 142*c*. As a result, liquid in the pump room formed in the diameter-reducing portion 142*c* between the knock bar 148 and the induction bar 150 and the diameter-reducing portion 142*c* is pushed forth by pumping action, so that it is supplied to the brush 162. This makes possible application of the viscous liquid with the brush 162.

Even if the knock cap 158 is inadvertently knocked when the liquid container is not being used, since the pump shelf portion 148*a* of the knock bar 148 slides on the ribs 142*a* of the tank portion 142 in the early stage of knocking and no sealed room is formed between the tank portion 142 and the knock bar 148/the induction bar 150, the liquid can be prevented from being unexpectedly discharged from the brush 162. Since ribs 142*a* are provided so that the knock bar 148 can slide on top of them, the knock bar will not move undesirably radially, but moves steadily axially. In addition, if the length of the ribs 142*a* is properly set, the play before the pumping action starts can be adjusted.

When the cap 112 is attached to the liquid container 140, since the tip of the brush 162 of the liquid container 140 is inserted into the inside space of the inner cap 120 and the tank portion 142 of the liquid container 140 pushes the opening/closing member 119 toward the innermost portion 113*a* of the cap body 113 against the energizing force of the spring 124, as shown in FIG. 1, the transverse hole 118*b* of the cylindrical portion 118 communicates with the innermost portion 113*a* of the cap body 113, which allows the vaporized solvent out of the solvent-impregnation medium 114 to pass through the transverse hole 118*b*, the passage made up of the longitudinal hole 118*c* and the communication groove 117*b*, the solvent passage 122, and the openings 120*b* of the inner cap 120 and to reach the brush 162 of the liquid container 140, as a result of which the brush 162 is moistened and prevented from being dried up. Even if the liquid container 140 is knocked inadvertently with the cap 112 attached to the liquid container 140, causing the pump shelf portion 148*a* of the above knock bar 148 to move from the ribs 142*a* to the diameter-reducing portion 142*c*, as a result of which the liquid springs out from the brush 162, the viscous liquid will scatter only within the inner cap 120, but the openings 120*b* of the inner cap 120 will never be blocked up since they are located near the base portion of the brush 162 which is hard for the scattered liquid to reach. In addition, as the openings 120*b* can be designed to have a larger area of, they will never be blocked up. Thus the viscous liquid will stick to the internal surface of the inner cap 120 and be solidified, but it will never block up the above solvent passage 122.

When the cap 112 is detached from the liquid container 140, the opening/closing member 119 is pushed away from the partition member 116 by the spring 124, and the flange portion 117 tightly touches the above flat face 116*d* of the projecting edge 116*b* of the partition member 116. At this point, the transverse hole 118*b* of the cylindrical portion 118 escapes from the innermost portion 113*a* of the cap body 113, as a result, the innermost portion 113*a* of the cap body 113 is sealed and the solvent in the solvent-impregnation medium 114 is prevented from vaporizing and flowing out.

Since the flange portion 117 is configured as a separate component of the cylindrical portion 118, when the flange portion 117 is molded, it is possible to mold the flange portion 117 in unsplit mold without being affected by the shape of the cylindrical portion 118 formed with the transverse hole 118*b*. Thereby, since there doesn't occur any parting line on the outer surface of the flange portion 117, when the flange portion 117 touches the flat face 16*d* of the portion member 116, there can be prevented such a situation that any unintended gap is formed caused by the existence of the parting line to raise evaporating outflow of the solvent.

Furthermore, when the cap 112 is attached to the liquid container 140 with the open side portion 113*b* of the cap body 113 kept lower than the innermost portion 113*a* thereof, the solvent in the solvent-impregnation medium 114 is likely to move downwardly and to flow out through the transverse hole 118*b* in the form of liquid into the open side portion 113*b* away from the partition member 116. However, due to the projecting edge 16*b* which projects toward the innermost portion 113*a*, most solvent liquid will stay in the periphery of the projecting edge 116*b* and never flow out.

If slight movement occurs radially when the cylindrical portion 118 integrated with the flange portion 117 slides through the through-hole 116*a*, since the projecting edge 116*b* has an inclined face 116*c* formed on it through which the displacement can be corrected, the flange portion 117 can be reliably induced toward the flat face 116*d*.

Further, since the taper portion 120*a* of the inner cap 120 spreads radially outwardly, when the cap 112 is attached to the tank portion 142, the taper portion 120*a* is prevented from interfering with the brush 162 and the brush 162 is prevented from being damaged.

In the embodiments described above, the brush 162 was taken for example of an application tip body, however the invention is not intended to be limited to the specific embodiments, and even a thin tube or stick-shaped body is applicable.

In this embodiment, cosmetic nail polish, correction fluid or the like were taken for example of a liquid, and such a cap as has within its cap body 113 a solvent-impregnation medium 114 for the prevention of the application tip body from being dried up was taken for example of a cap 112, however the invention is not intended to be limited to the specific embodiments. And needless to say, in cases where the prevention of the application tip body is not necessary, it is needless to say that an ordinary cap which do not have a solvent-impregnation medium 114 may be used.

As described above, according to the present invention, even when the knock bar is biased forward as a result of the wrong operation of the knock body, since the pump shelf portion of the knock bar slides on top of the ribs of the tank portion in the early stage of knocking so that no pump room will be formed between the tank portion and the knock bar/induction bar, the liquid is prevented from being unexpectedly discharged from the application tip body. Since the knock bar slides on top of the ribs, it dose not move undesirably radially, but moves steadily axially.

What is claimed is:

1. A liquid container comprising:

a tank portion for receiving a liquid;

a knock bar stretching axially movably within the tank portion which is designed to have on its axial tip a pump shelf portion whose diameter have been enlarged;

an induction bar fixed into the tip of the knock bar for opening/closing a tip opening of the tank portion;

an application tip body provided on the tip side of the induction bar;

energizing means for always energizing the above knock bar and induction bar rearward;

a knock body operatable to bias the knock bar within the above tank portion forward;

wherein a plurality of ribs are axially formed on the internal periphery surface of the above tank portion and on top of which the above pump shelf portion can slide, the internal periphery surface ahead of the ribs of the tank portion is at the same level as and continuous with the top face of the ribs and designed as a diameter-reducing portion where the pump shelf portion can slide, and the pump shelf portion of the knock bar slidably touches the top of the ribs when it is not biased.

2. The liquid container according to claim 1, further comprising a tail stopper fixed on a rear end portion of the tank portion, a rear ring fitted on a rear end of the tail stopper, and a bellows-shaped elastic body sandwiched between the tail stopper and the rear ring.

3. The liquid container according to claim 2, wherein the tail stopper, the rear ring and the elastic body configure a previously integrally formed unit.

4. The liquid container according to claim 3, wherein it further comprises a cap which is adapted to be detachably attached on a tip portion of the tank portion and designed to protect the application tip body, the cap comprising: a cap body, a solvent-impregnation medium which is impregnated with a solvent for preventing the above application tip body from being dried up and housed in an inner side portion of an inside of the cap body, a partition member fixed within the cap body for dividing the above solvent-impregnation medium from an open side portion of the cap body, solvent flowing-out means provided radially almost centrally in the above partition member for letting the vaporized solvent out of the solvent-impregnation medium flow out, an opening/closing member disposed within the open side portion of the cap body for opening/closing the above solvent flowing-out means, energizing means for always energizing the opening/closing means in such a direction as to close the solvent flowing-out means, and an inner cap fixed inside the above opening/closing member, wherein a solvent passage for letting the vaporized solvent from the above solvent flowing-out means pass through is defined between the external surface of the above inner cap and the internal surface of the above opening/closing member, further a second solvent passage via which the above solvent passage and the above application tip body communicate with each other is formed between the external and internal surfaces of the inner cap, and when the cap is attached to the liquid container, the above opening/closing member is biased so that it opens the above solvent flowing-out means, while the above application tip body being inserted into the above inner cap, as a result of which the vapored solvent out of the solvent-impregnation medium is allowed to pass through the solvent flowing-out means, the above solvent passage and the second solvent passage, so as to reach the application tip body.

5. The liquid container according to claim 2, wherein it further comprises a cap which is adapted to be detachably attached on a tip portion of the tank portion and designed to protect the application tip body, the cap comprising: a cap body, a solvent-impregnation medium which is impregnated with a solvent for preventing the above application tip body from being dried up and housed in an inner side portion of an inside of the cap body, a partition member fixed within the cap body for dividing the above solvent-impregnation medium from an open side portion of the cap body, solvent flowing-out means provided radially almost centrally in the above partition member for letting the vaporized solvent out of the solvent-impregnation medium flow out, an opening/closing member disposed within the open side portion of the cap body for opening/closing the above solvent flowing-out means, energizing means for always energizing the opening/closing means in such a direction as to close the solvent flowing-out means, and an inner cap fixed inside the above opening/closing member, wherein a solvent passage for letting the vaporized solvent from the above solvent flowing-out means pass through is defined between the external surface of the above inner cap and the internal surface of the above opening/closing member, further a second solvent passage via which the above solvent passage and the above application tip body communicate with each other is formed between the external and internal surfaces of the inner cap, and when the cap is attached to the liquid container, the above opening/closing member is biased so that it opens the above solvent flowing-out means, while the above application tip body being inserted into the above inner cap, as a result of which the vapored solvent out of the solvent-impregnation medium is allowed to pass through the solvent flowing-out means, the above solvent passage and the second solvent passage, so as to reach the application tip body.

6. The liquid container according to claim 1, wherein it further comprises a cap which is adapted to be detachably attached on a tip portion of the tank portion and designed to protect the application tip body, the cap comprising: a cap body, a solvent-impregnation medium which is impregnated with a solvent for preventing the above application tip body from being dried up and housed in an inner side portion of an inside of the cap body, a partition member fixed within the cap body for dividing the above solvent-impregnation medium from an open side portion of the cap body, solvent flowing-out means provided radially almost centrally in the above partition member for letting the vaporized solvent out of the solvent-impregnation medium flow out, an opening/closing member disposed within the open side portion of the cap body for opening/closing the above solvent flowing-out means, energizing means for always energizing the opening/closing member in such a direction as to close the solvent flowing-out means, and an inner cap fixed inside the above opening/closing member, wherein a solvent passage for letting the vaporized solvent from the above solvent flowing-out means pass through is defined between the external surface of the above inner cap and the internal surface of the above opening/closing member, further a second solvent passage via which the above solvent passage and the above application tip body communicate with each other is formed between the external and internal surfaces of the inner cap, and when the cap is attached to the liquid container, the above opening/closing member is biased so that it opens the above solvent flowing-out means, while the above application tip body being inserted into the above inner cap, as a result of which the vapored solvent out of the solvent-impregnation medium is allowed to pass through the solvent flowing-out means, the above solvent passage and the second solvent passage, so as to reach the application tip body.

7. A liquid container according to claim 6, wherein the second solvent passage is an opening formed in a periphery surface of the inner cap.

8. The liquid container of claim 7, wherein the above solvent flowing-out means comprises a through-hole formed radially almost centrally in the partition member, a cylindrical portion sliding through the through-hole, and a flange portion which is formed independently of the cylindrical portion and integrally connected to the tip side of the cylindrical body, in the cylindrical portion a hole is formed via which the inner side portion of the inside of the cap body and the solvent passage communicate with each other, a periphery of the through-hole in the partition member is a projecting edge projecting toward the innermost portion of the inside of the cap body, and the projecting edge is tightly touchable to the flange portion.

9. The liquid container according to claim 6, wherein the above solvent flowing-out means comprises a through-hole formed radially almost centrally in the partition member, a cylindrical portion sliding through the through-hole, and a flange portion which is formed independently of the cylindrical portion and integrally connected to a tip side of the cylindrical portion, in the cylindrical portion a hole is formed via which the inner side portion of the inside of the cap body and the solvent passage communicate with each other, a periphery of the through-hole in the partition member is a projecting edge projecting toward the inner side portion of the inside of the cap body, and the projecting edge is tightly touchable to the flange portion.

* * * * *